US006893297B2

(12) United States Patent
Chen

(10) Patent No.: US 6,893,297 B2
(45) Date of Patent: May 17, 2005

(54) POWER ADAPTER

(75) Inventor: Chun-Chen Chen, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/759,834

(22) Filed: Jan. 16, 2004

(65) Prior Publication Data

US 2004/0147150 A1 Jul. 29, 2004

(30) Foreign Application Priority Data

Jan. 20, 2003 (TW) ..... 92101165 A

(51) Int. Cl.[7] ..... H01R 13/64
(52) U.S. Cl. ..... 439/680
(58) Field of Search ..... 439/680, 171–177, 439/372, 357–358, 352

(56) References Cited

U.S. PATENT DOCUMENTS 6,086,395 A * 7/2000 Lloyd et al. ..... 439/172
6,328,581 B1 * 12/2001 Lee et al. ..... 439/106
6,592,392 B2 * 7/2003 Po-Heng ..... 439/358
6,669,495 B2 * 12/2003 Philips et al. ..... 438/170

* cited by examiner

*Primary Examiner*—J. F. Duverne
(74) *Attorney, Agent, or Firm*—Volpe and Koenig, PC

(57) ABSTRACT

A power adapter is provided. The power adapter includes a case having an indented region, a conducting terminal and an opening, wherein the conducting terminal is located in the indented region, and an connector includes a main body comprising a first surface, a second surface, and a depression having a bottom surface and located at the second surface, a conducting piece having a first end and a second end, wherein the first end is protruded out of the first surface, and the second end is protruded out of the bottom surface and falls short of the second surface, an arm laterally extended from the main body, and a protruding portion located on an end of the arm away from the main body, wherein the connector is putted into the indented region as in a first position, and then the connector is rotated through an angle to be in a second position so that the protruding portion is wedged into the opening and the main body is fixed in the indented region.

19 Claims, 8 Drawing Sheets

POWER ADAPTER

FIELD OF THE INVENTION

This invention relates to a power adapter, and more particular to a power adapter which has a better assembling stability and a simpler and more economical manufacturing process.

BACKGROUND OF THE INVENTION

Generally, a power adapter is always used for adapting different sockets provided in different countries when traveling all over the world. Therefore, a connector of the power adapter for connecting with the socket also must be exchangeable for adapting, and thus, now, the power adapter always has different connectors and each of which can be exchanged. Hence, how to smooth the exchange of each connector and how to economically achieve the exchange both become a key point in manufacturing.

Please refer to FIG. 1A which illustrates a schematic view of a conventional power adapter. As shown in FIG. 1A, a connector 11 is assembled with a main body 12 of the power adapter 10 through sliding, and the connector 11 and the main body 12 are engaged with each other through an engaging element 121. However, this power adapter still has some defects in manufacturing or during operation.

Please also refer to FIG. 1B which illustrates a perspective drawing showing a connector of the conventional power adapter. As shown in FIG. 1B, the connector 11 includes conducting pieces 111 and 112, wherein the conducting pieces 112 are located inside the connector and would not be seen when the connector 11 is sealed. It can be clearly seen from FIG. 1B that, for being contacted with the conducting terminal 122, the conducting pieces 112 must be bent, and thus, it is obvious that one manufacturing step should be introduced for bending the conducting terminals 112 toward the conducting piece 111. Naturally, no matter in cost or in time, this structure needs more labors.

In addition to one additional manufacturing step for bending the conducting terminals into a specific angle so as to increase the manufacturing time, for covering the conducting pieces 112 which are contacted by the conducting terminals 111, the material needed by this connector must be increased, too. Therefore, the manufacturing process of the conventional power adapter is actually very complicated and should be simplified.

Moreover, as shown in FIG. 1A, the separation between the connector 11 and the main body 12 is mediated by a "push" button 123 on the main body. Because the engaging element 121 is controlled by the "push" button 123, the engagement between the connector 11 and the main body 12 can be released through pushing the "push" button by the user. However, this design is disadvantageous that this power adapter obviously can not completely stay close to the socket as the conducting pieces 111 are plugged therein because of the thickness of the "push" button, and further, the "push" button 123 might also be miss-touched so that the connector 11 will be separated from the main body 12 at an inappropriate time. Furthermore, for forming this additional element, this design will need still another manufacturing step and time which is no doubt a waste in cost and in time.

Because of the technical defects described above, the applicant keeps on carving unflaggingly to develop a "power adapter" through wholehearted experience and research.

SUMMARY OF THE INVENTION

In accordance with an aspect of the present invention, a power adapter includes a case having an indented region, a conducting terminal and an opening, wherein the conducting terminal is located in the indented region, and an connector include's a main body comprising a first surface, a second surface, and a depression having a bottom surface and located at the second surface, a conducting piece having a first end and a second end, wherein the first end is protruded out of the first surface, and the second end is protruded out of the bottom surface and falls short of the second surface, an arm laterally extended from the main body, and a protruding portion located on an end of the arm away from the main body, wherein the connector is putted into the indented region as in a first position, and then the connector is rotated through an angle to be in a second position so that the protruding portion is wedged into the opening and the main body is fixed in the indented region.

Preferably, the main body has a circular shape.

Preferably, the main body, the arm and the protruding portion are integrally formed.

Preferably, the conducting piece is made of a non-crooked conductive material.

Preferably, the case further comprises a guiding channel for providing a pathway for the arm and the protruding portion to be rotated from the first position to the second position.

Preferably, the guiding channel has a first end located at a vertical height relatively higher than that of a second end thereof.

Preferably, the first end of the guiding channel is an entrance for the protruding portion.

Preferably, the second end of the guiding channel is an exit for the protruding portion.

Preferably, the protruding portion and the arm are flexible structures.

Preferably, the indented region further comprises a first blocking structure located on a side wall of the indented region.

Preferably, the connector further comprises a second blocking structure located on an outer surface of the connector.

Preferably, positions of the first structure and, the second structure are corresponded to each other when the case and the connector are assembled together.

Preferably, the angle is ranged from 5 to 90 degrees.

Preferably, when the protruding portion is wedged in the opening, a top point of the protruding portion is relatively lower than an upper surface of the case.

Preferably, the connector further comprises a flexible element located between the arm and the main body.

In accordance with another aspect of the present invention, a power adapter includes a case having an indented region, a conducting terminal and a first blocking structure, wherein the first blocking structure further comprises a first fixing device, and an connector includes a main body comprising a first surface, a second surface, and a depression having a bottom surface and located at the second surface, a conducting piece having a first end and a second end, wherein the first end is protruded out of the first surface, and the second end is protruded out of the bottom surface and not overrun the second surface, and a second blocking structure mounted on an outer surface of the connector, wherein the second blocking structure further comprises a second fixing device, wherein when the connector is putted into the indented region as in a first position and then the connector is rotated through an angle to be in a second position, the first fixing device and the second fixing device are engaged with each other for fixing the connector in the indented region.

Preferably, the conducting terminal is located in the indented region.

Preferably, the first device is an indented trough.

Preferably, the second device is a convex.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

As described above, because the conventional power adapter is difficult in assembling and inconvenient during using, it is an object of the present invention to provide a power adapter which employs an engagement between an opening on the main body and a protruding portion on the connector and/or between a first blocking structure on the main body and a second blocking structure on the connector for stably fixing the connector on the main body so as to avoid the connector form being departed from the main body during operation.

Another object of the present invention is to provide a power adapter which can reduce the manufacturing steps through the corresponding structures respectively on the connector and the main body so as to reduce the cost.

Another further object of the present invention is to provide a power adapter which can reduce the inconvenience for the user during using.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1A:
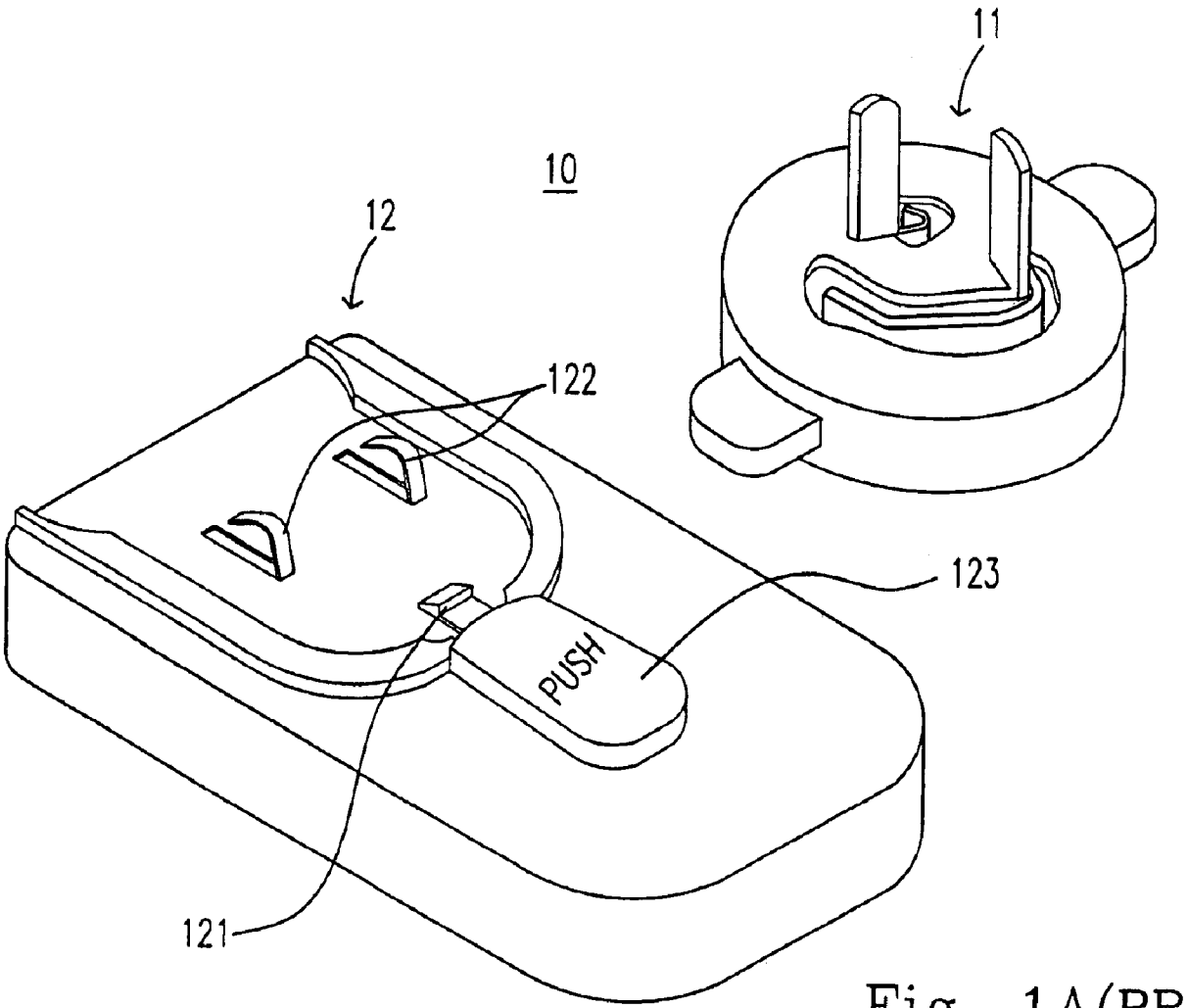
Fig. 1A(PRIOR ART)
FIG. 1A is a schematic view showing a power adapter in the prior art.
Figure 1B:
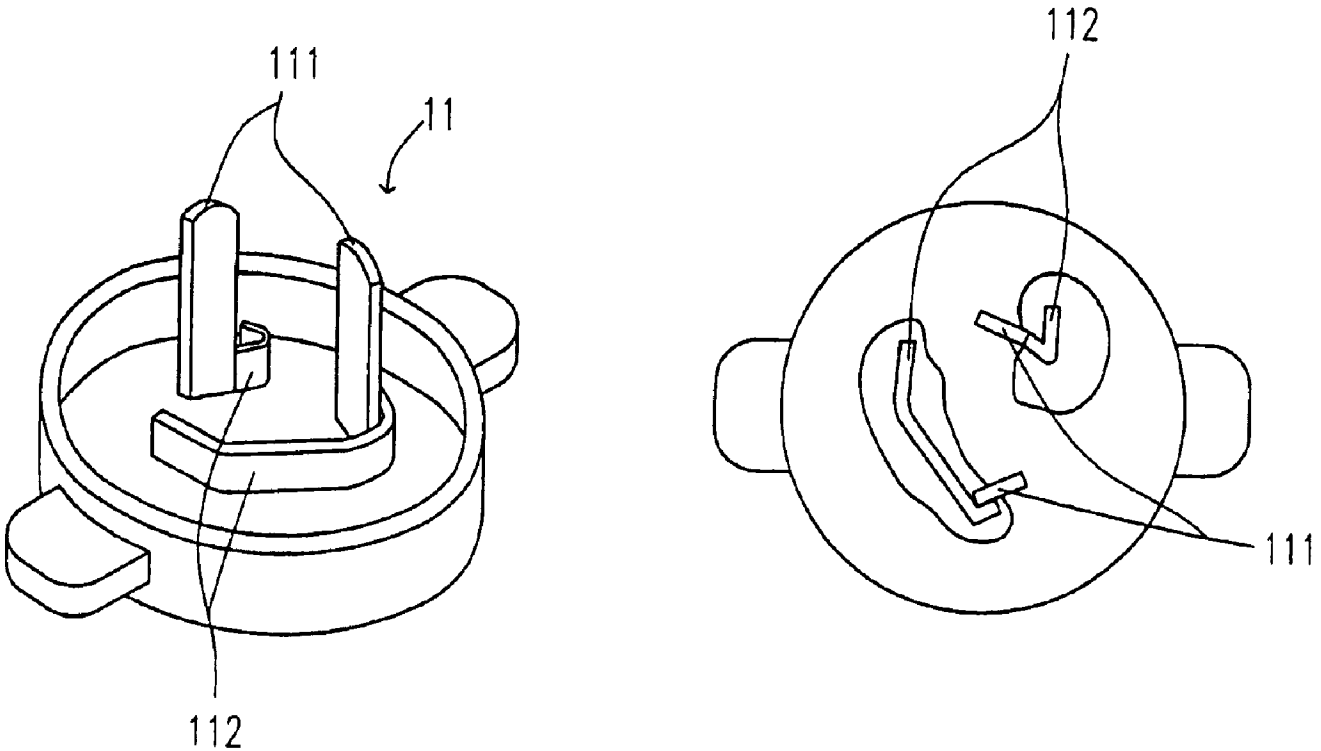
Fig. 1B(PRIOR ART)
FIG. 1B is a perspective drawing showing a connector of a conventional power adapter.
Figure 2A:
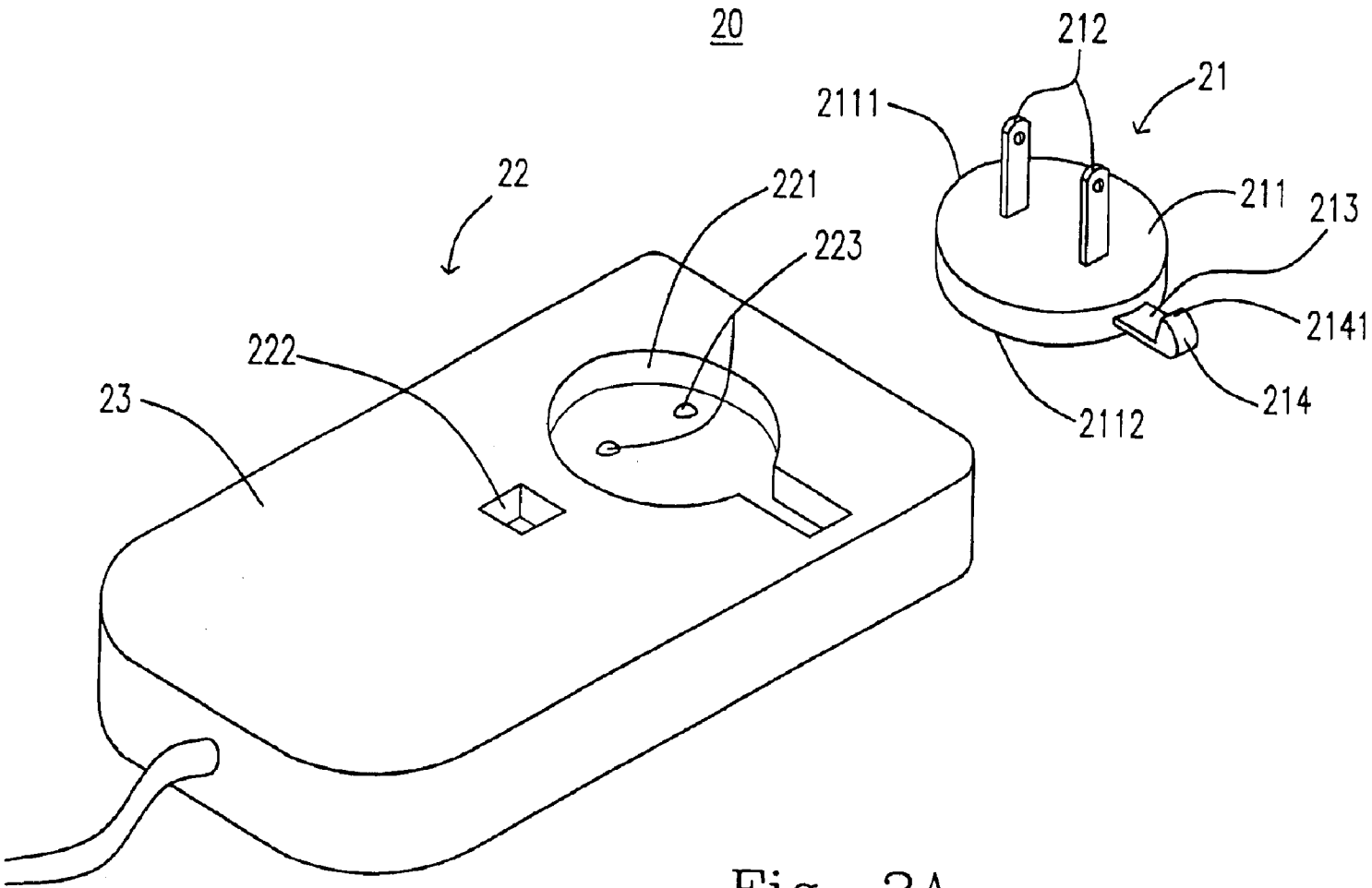
FIG. 2A is a structural schematic view showing a power adapter in a first preferred embodiment according to the present invention.
Figure 2B:
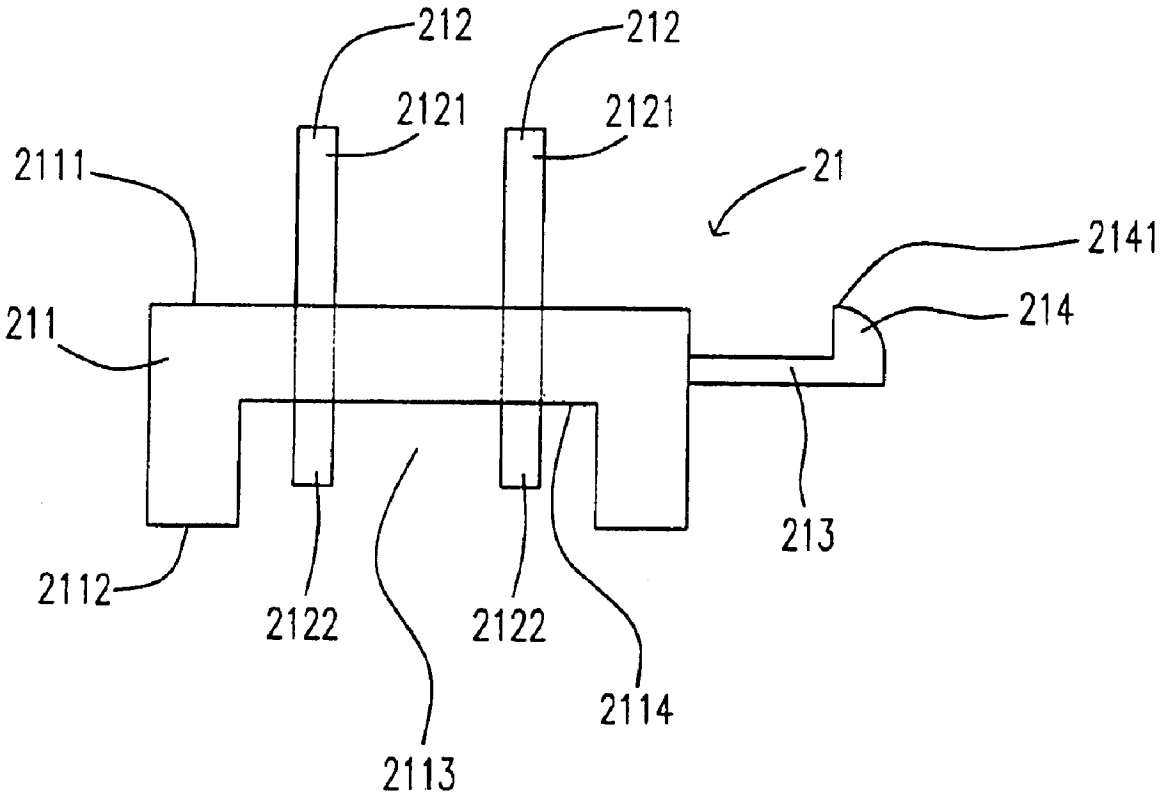
FIG. 2B is a lateral view showing a connector of the power adapter in FIG. 2A according to the present invention.

Please refer to FIG. 2A which illustrates a schematic view of a power adapter in a first preferred embodiment according to the present invention and FIG. 2B which is a lateral view showing the connector of the power adapter in FIG. 2A. As in FIGS. 2A~2B, a power adapter 20 include a case 22 and a connector 21, wherein the case includes an indented region 221, two conducting terminal 223 and an opening 222, and the conducting terminals 223 are located in the indented region 221. It is noted that the number of the conducting terminals can be changed for conforming to different demands and should not be limited. And, the connector 21 includes a main body 211, two conducting pieces 212, an arm 213 and a protruding portion 214, wherein the main body 211 includes a first surface 2111, a second surface 2112 and a depression 2113 which has a bottom surface 2114 and is located at the second surface 2112. It should also be noted that the numbers of the conducting pieces and the depression also can be changed for conforming to different demands and should not be limited.

In the present invention, the main body 211 of the connector 21 has a circular shape and the arm 213 has a rectangular shape, and because the connector 21 should be exactly positioned in the indented region 221 of the main body 21 for forming the power adapter 20, the shape of the indented region 221 is determined by that of the connector and the arm. As shown in this preferred embodiment, the shape of the indented region is equal to a circle plus a rectangle, but should not be limited.

The conducting pieces 212 on the connector 21 respectively have a first end 2121 and a second end 2122, wherein the first end 2121 is protruded out of the first surface 2111 of the main body 211 and the second end 2112 is protruded out of the bottom surface 2114 of the depression 2113 and falls short of the second surface 2112. The arm 213 of the connector 21 is laterally connected to the main body 211 and further includes a protruding portion 214 located on an end of the arm 213 away from the main body 211 for being wedged into the opening 222 on the case 22. When the connector 31 is positioned in the indented region 221 as in a first position and then rotated through an angle to be in a second position, the protruding portion 214 on the arm 213 can be wedged into the opening 222 of the case 22 so that the connector 21 can be stably fixed with the case 22 and the conducting piece 212 can be contacted with the conducting terminal 223 for electrical conduction.

Moreover, the conducting piece of the present invention is made of a non-crooked conductive material. The first end 2121 of the conducting piece 212 which is protruded out of the first surface 2111 of the main body 211 is employed to be plugged into a socket, and the second end 2122 of the conducting piece 212 which is protruded out of the bottom surface 2114 of the depression 2113 is employed to contacted with the conducting terminal 223 for electrical conduction when the connector 21 is positioned into the indented region 221.

As to the arm 213 and the protruding portion thereon 214, in the present invention, both or one of them can be made of a flexible material for facilitating the engagement and separation between the connector and the case. Or, both of them can be made of a non-flexible material, and then, an additional flexible element (not shown) should be provided between the arm 213 and the main body 211 also for facilitating the engaging and separation.

When the user wants to assemble the connector and the case, firstly, the whole connector 21 has to be adjusted to be in the first position, where the main body 211, the arm 213 and the protruding portion 214 can be exactly putted into the indented region 221, and at this time, the second end 2122 of the conducting piece 212 which is hided in the depression 2113 will be contacted with the conducting terminal 223 in the indented region 221. Continuously, after putting the connector 21 into the indented region 221, the user can clockwise or counterclockwise rotate the connector 21 through an angle so that the connector 21 will be in the second position, wherein the angle is ranged from 5 to 90 degrees. As the connector is in the second position, the protruding portion 214 on the arm 213 will be exactly bounced up so as to be wedged into the opening 222 of the case 22, and thus the connector 21 can be assembled with the case 22. Alternatively, for conforming different demands, when the connector is in the first position, the second end 2122 of the conducting piece 212 would not have to be contacted with the conducting terminal 223 until the connector is rotated to the second position where the electrical conduction is needed.

When the user wants to exchange the connector 21, the user only need to press down the protruding portion 214 which is wedged in the opening 222 and then the engagement between the connector 21 and the case 22 can be easily released so that the connector 21 now can be rotated from the first position to the second position and be taken out from the indented region 221. Then, the user only needs to re-put another connector into the indented region 221 and identically rotate the connector to wedge the protruding portion into the opening for completing the assembling.

In the present invention, when the protruding portion 214 of the connector 21 is wedged into the opening 222, a top point 2141 of the protruding portion 214 is relatively lower than an upper surface 23 of the case 22 so that when the power adapter is plugged into a socket through the conducting pieces and the upper surface of the case is pressed close to the socket, the miss-touched condition which will be occurred in the prior art can be totally avoided.

Figure 3:
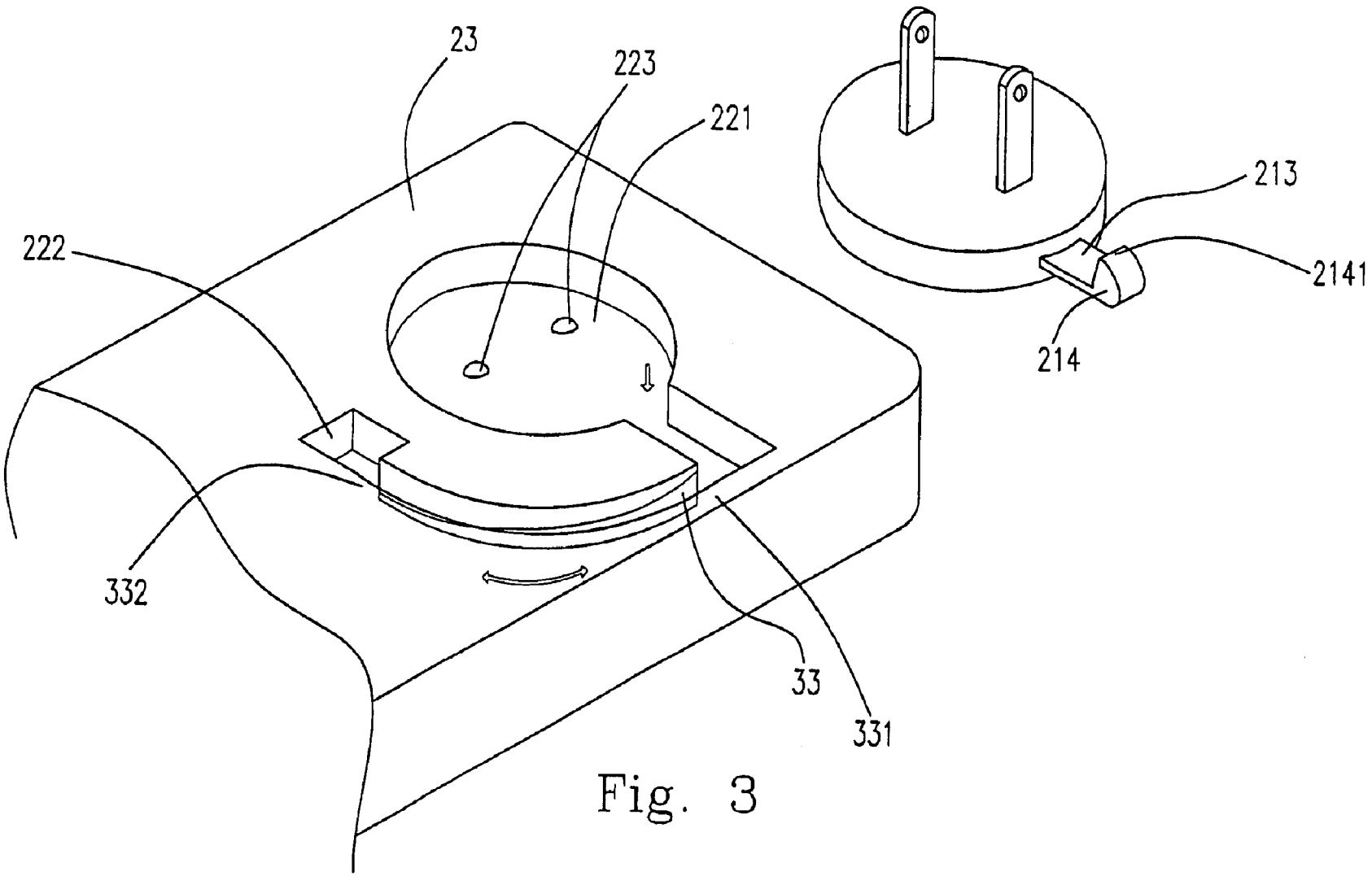
FIG. 3 is a perspective drawing showing a guiding channel in a main body and the relationship between a connector and the guiding channel in a first preferred embodiment according to the present invention.

Please refer to FIG. 3 which is perspective drawing showing a guiding channel in a main body and the relationship between a connector and the guiding channel in a first preferred embodiment according to the present invention. When the connector 21 is assembled with the case 22, because the connector 21 has to be rotated through an angle, a guiding channel 33 inside the case 22 is provided for mediating the rotation, namely, the guiding channel 33 is the pathway passed by the arm 213 and the protruding portion 214 when being rotated from the first position to the second position, wherein the angle is ranged from 5 to 90 degrees. Moreover, the guiding channel 33 further includes a first end 331 and a second end 332, wherein the first end 331 is an entrance for the arm 213 and the protruding portion 214 and the second end 332 is an exit of the arm 213 and the protruding portion 214.

However, it is noted that the guiding channel 33 is not a horizontal channel and the first end 331 is located at a vertical height relatively higher than that of the second end 332, that is to say, the vertical height of the channel is gradually decreased from the first end 331 to the second end 332. Namely, when the connector is gradually rotated from the first position to the second position, the arm 213 and the protruding portion 214 will gradually be pressed down by the gradually decreased height of the guiding channel 33, and when the connector is in the second position, namely, the protruding portion 214 arrives the opening 222, the protruding portion 214 will depart from the guiding channel 33 and automatically bounce up so as to be wedged into the opening 222. But, it also should be noted that in the present invention, the vertical height of the top point of the protruding portion will not be higher than that of the upper surface of the case, and because the arm 213 and the protruding portion 214 are made of flexible material, they will not be broken by the pressure from the guiding channel 33 and can be smoothly passed therethrough.

Consequently, the preferred embodiment described above can easily avoid the "push" button which might be miss-touched in the prior art through a cooperation of the arm and the protruding portion on the connecter and the corresponding indented region and guiding channel in the case. Furthermore, in manufacturing, because the main body, the arm and the protruding portion of the connector can be formed integrally and the corresponding case does not need to further employ an additional element, for example, the "push" button, and proceed another manufacturing step, for example, bending the conducting terminal, the manufacturing steps of the power adapter according to the present invention can be simplified.

Certainly, because the direction of the power adapter has to match up that of the socket when using, the direction of the conducting piece in the present invention would not be limited. That means, for achieving this purpose, the number of the opening can be more than one and the number of the guiding channel also can be increased for conforming to the increase of the opening, and therefore, the connector can be rotated more than once for being adjusted into different angles for conforming to the socket so as to avoid the inconvenience.

Figure 4A:
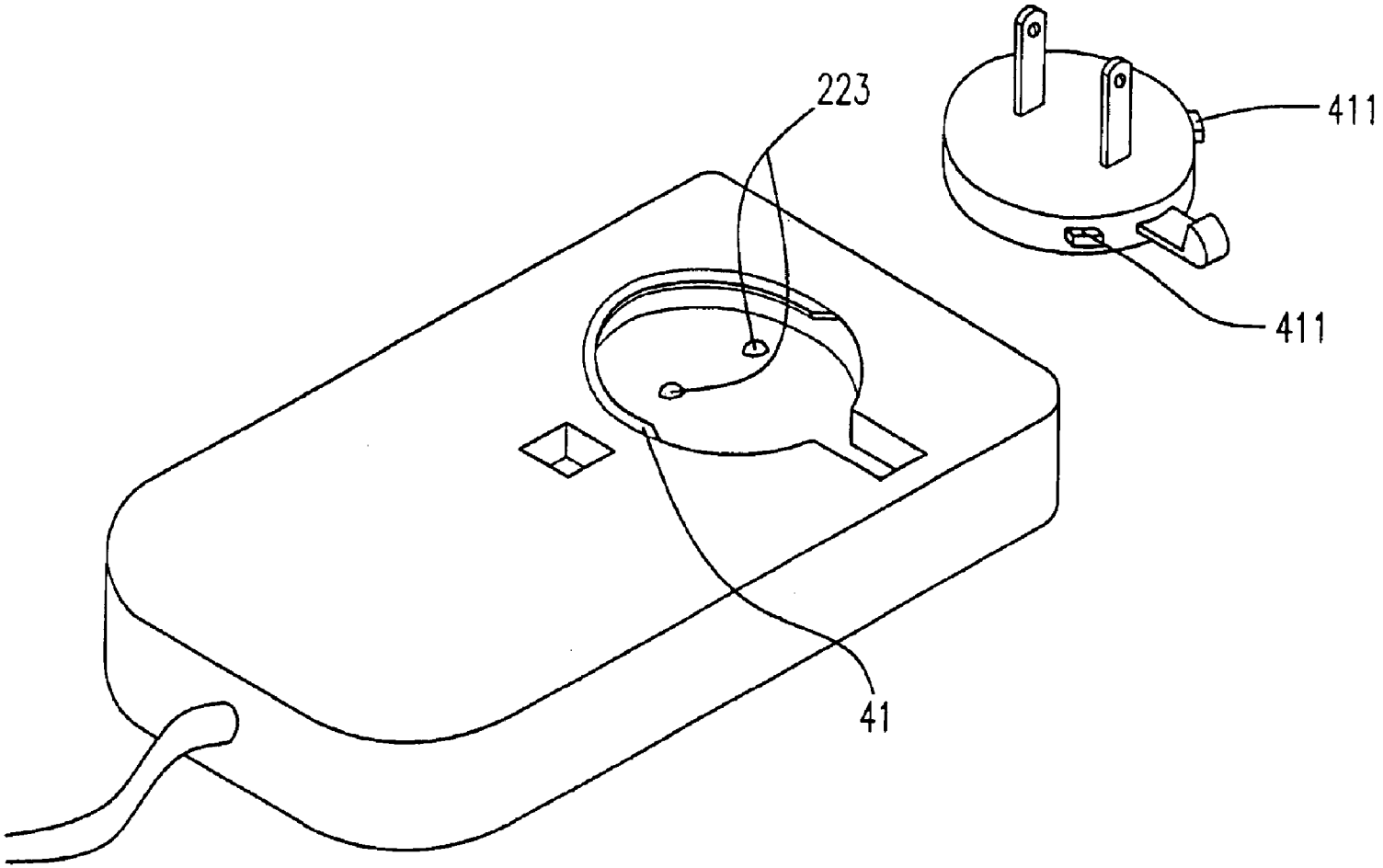
FIG. 4A is a schematic view showing a power adapter in a second preferred embodiment according to the present invention.
Figure 4B:
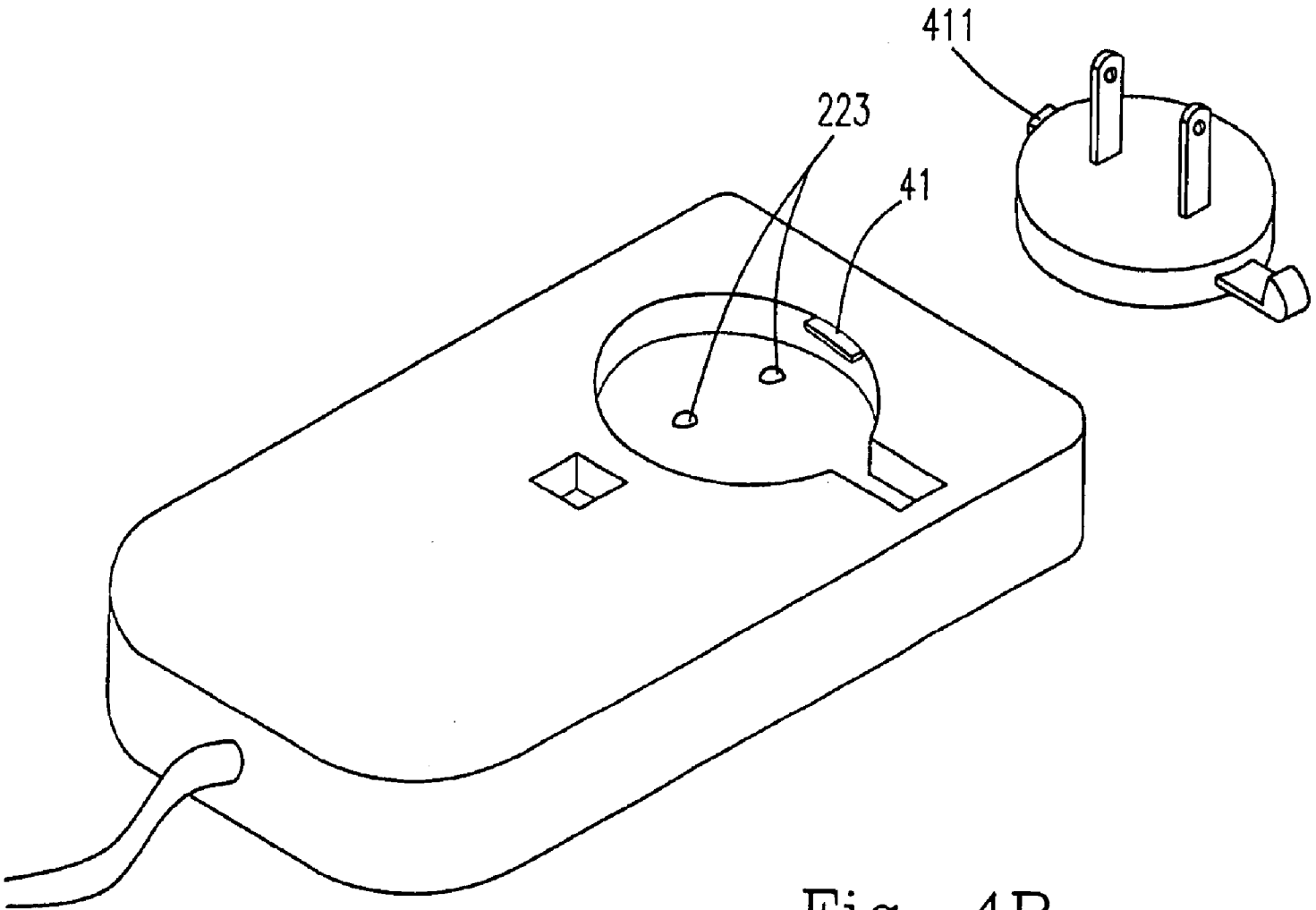
FIG. 4B shows is a schematic view showing a power adapter in a third preferred embodiment according to the present invention.

Additionally, the power adapter according to the present invention can further employ blocking structures for more stably fixing the connector on the case, as shown in FIGS. 4A~4B, which show the second and the third preferred embodiments according to the present invention. As shown in these figures, a first blocking structure 41 is located on a side wall of the indented region 221 and correspondingly, a second blocking structure 411 is located on an outer surface of the connector 21. Namely, when connector 21 is rotated from the first position to be in the second position, the second blocking structure 411 can be engaged against the first blocking structure 41. Certainly, the first and the second blocking structures only need to be located at the positions which are corresponded to each other when the connector and the case are assembled together and do not need to be limited. Thus, FIG. 4A and FIG. 4B respectively illustrate different preferred embodiments of the blocking structures and each of them can achieve the purpose of stable engagement. But, it should also be noted that these embodiments are only employed for illustrating and the positions and forms of the blocking structure should not be limited by these illustrated embodiments.

Figure 5:
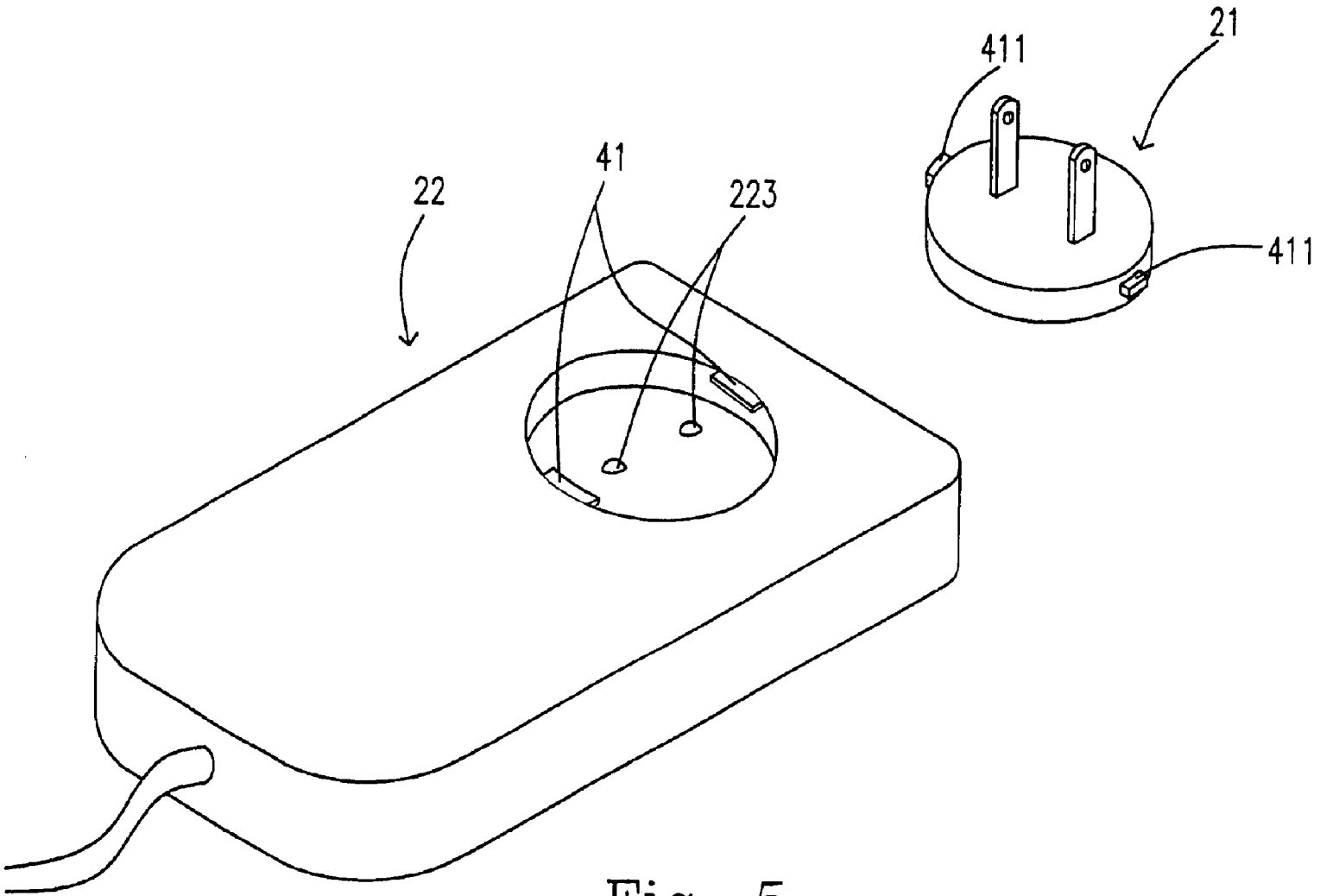
FIG. 5 is a schematic view showing a power adapter in a fourth preferred embodiment according to the present invention.

Please refer to FIG. 5 which illustrates a fourth preferred embodiment of the power adapter according to the present invention. In this preferred embodiment, the opening 222 on the case 22 and the arm 213 and the protruding portion 214 on the connector 21 are saved so that the engagement between the connector 21 and the case 22 is achieved by the first blocking structure 41 and the second blocking structure 411. Identically, the positions, the number, and the forms of the blocking structures in this preferred embodiment are all changeable for conforming to different demands and also for more stable fixity, and the only limitation is the first blocking structure and the second structure should be corresponded to each other when the connector and the case are assembled together.

Furthermore, the first blocking structure further includes a first fixing device (not shown) and the second blocking structure further includes a second fixing device (not shown), wherein the first fixing device can be an indented trough or a convex and the second device can be a convex or a trough, namely, one fixing devices should be wedged into the other fixing device. And, the first and the second fixing devices are employed for positioning the connector, that is to say, the second position of the connector is determined by the cooperation of the two fixing devices.

Accordingly, because the power adapter according to the present invention is advantageous of saving one manufacturing step for bending the conducting pieces of the connector and an integral formation of the arm, the protruding portion and the main body of the connector, the power adapter according to the present invention should be a simplest and most economical design. Moreover, the case which includes the opening and the guiding channel therein also can be formed integrally and does not need to assemble other elements, for example, the "push" button, so that this should also be a simple and convenient structure in manufacturing. Furthermore, the present invention is further advantageous that the assembling between the connector and the case can be easily proceeded, and the engagement therebetween is also stable and has to be released through pressing the protruding portion on purpose for avoiding the miss-touched condition. Therefore, the power adapter according to the present invention is really a superior design as compared with the prior art.

In view of the aforesaid, because of solving the defects of one additional manufacturing step of bending the conducting terminal, forming an additional element, i.e. the "push" button, and easily separated connector, which is caused by miss-touching, the present invention can easily achieve a simple, low cost and less time waste power adapter in manufacturing and is really a creative invention and extremely suitable for industrial production.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter, comprising:

a case having an indented region, a conducting terminal and an opening, wherein said conducting terminal is located in said indented region; and an connector, comprising:

a main body comprising a first surface, a second surface, and a depression having a bottom surface and located at said second surface;

a conducting piece having a first end and a second end, wherein said first end is protruded out of said first surface, and said second end is protruded out of said bottom surface and falls short of said second surface;

an arm laterally extended from said main body; and a protruding portion located on an end of said arm away from said main body, wherein said connector is putted into said indented region as in a first position, and then said connector is rotated through an angle to be in a second position so that said protruding portion is wedged into said opening and said main body is fixed in said indented region.

2. The power adapter according to claim 1, wherein said main body has a circular shape.

3. The power adapter according to claim 1, wherein said main body, said arm and said protruding portion are integrally formed.

4. The power adapter according to claim 1, wherein said conducting piece is made of a non-crooked conductive material.

5. The power adapter according to claim 1, wherein said case further comprises a guiding channel for providing a pathway for said arm and said protruding portion to be rotated from said first position to said second position.

6. The power adapter according to claim 5, wherein said guiding channel has a first end located at a vertical height relatively higher than that of a second end thereof.

7. The power adapter according to claim 6, wherein said first end of said guiding channel is an entrance for said protruding portion.

8. The power adapter according to claim 6, wherein said second end of said guiding channel is an exit for said protruding portion.

9. The power adapter according to claim 1, wherein said protruding portion and said arm are flexible structures.

10. The power adapter according to claim 1, wherein said indented region further comprises a first blocking structure located on a side wall of said indented region.

11. The power adapter according to claim 10, wherein said connector further comprises a second blocking structure located on an outer surface of said connector.

12. The power adapter according to claim 11, wherein positions of said first structure and said second structure are corresponded to each other when said case and said connector are assembled together.

13. The power adapter according to claim 1, wherein said angle is ranged from 5 to 90 degrees.

14. The power adapter according to claim 1, wherein when said protruding portion is wedged in said opening, a top point of said protruding portion is relatively lower than an upper surface of said case.

15. The power adapter according to claim 1, wherein said connector further comprises a flexible element located between said arm and said main body.

16. A power adapter, comprising:

a case having an indented region, a conducting terminal and a first blocking structure, wherein said first blocking structure further comprises a first fixing device; and an connector, comprising:

a main body comprising a first surface, a second surface, and a depression having a bottom surface and located at said second surface;

a conducting piece having a first end and a second end, wherein said first end is protruded out of said first surface, and said second end is protruded out of said bottom surface and not overrun said second surface; and a second blocking structure mounted on an outer surface of said connector, wherein said second blocking structure further comprises a second fixing device, wherein when said connector is putted into said indented region as in a first position and then said connector is rotated through an angle to be in a second position, said first fixing device and said second fixing device are engaged with each other for fixing said connector in said indented region.

17. The power adapter according to claim 16, wherein said conducting terminal is located in said indented region.

18. The power adapter according to claim 16, wherein said first device is an indented trough.

19. The power adapter according to claim 16, wherein said second device is a convex.

* * * * *